United States Patent [19]

Takahashi et al.

[11] 4,155,660

[45] May 22, 1979

[54] DOT PRINTING WIRE

[75] Inventors: Ichiro Takahashi, Hiratsuka; Eiji Sekine, Kanagawa; Shiyoji Wada; Hiroshi Matubara, both of Hiratsuka, all of Japan

[73] Assignee: Pilot Man-Nen-Hitsu Kabushiki Kaisha, Tokyo, Japan

[21] Appl. No.: 776,373

[22] Filed: Mar. 10, 1977

[30] Foreign Application Priority Data

Mar. 10, 1976 [JP] Japan ..... 51/26455

[51] Int. Cl.[2] ..... B41J 3/12; C22C 5/04

[52] U.S. Cl. ..... 400/124; 75/172 R

[58] Field of Search ..... 197/1 R; 75/172 R, 172 E; 400/124

[56] References Cited

U.S. PATENT DOCUMENTS

| | | | |
|---|---|---|---|
| 1,753,162 | 4/1930 | Woodward | 75/172 R |
| 1,797,236 | 3/1931 | Klausmann et al. | 75/172 E |
| 2,082,719 | 6/1937 | Powell et al. | 75/172 R |
| 2,206,616 | 7/1940 | Devereux et al. | 75/172 R X |
| 2,279,763 | 4/1942 | Sivil | 75/172 E |
| 2,636,819 | 4/1953 | Streicher | 75/172 E |
| 3,480,429 | 11/1969 | Thiede et al. | 75/172 R X |
| 3,828,908 | 8/1974 | Schneider | 197/1 R |

*Primary Examiner*—Paul T. Sewell

*Attorney, Agent, or Firm*—Wenderoth, Lind & Ponack

[57] ABSTRACT

A dot printing wire is provided at its tip with a wear-resistant contact made of an alloy selected from the group consisting of alloys composed of two or more platinum group metals, alloys of platinum group metals and transition metals and alloys of platinum group metals, transition metals and boron.

7 Claims, 4 Drawing Figures

DOT PRINTING WIRE

BACKGROUND OF THE INVENTION

The present invention relates to a novel dot printing wire having a wear-resistant contact attached to the point thereof.

The term "dot printing" as used herein refers to a typing system wherein numerals and characters are composed and typed by a set of small points, i.e. dots, formed on a recording paper by causing selected wires from among several fine wires closely arranged to each other to strike the paper with proper timing through a copying material such as a carbon ribbon. Dot printing requires no provision of a large number of types in advance. In practice, only a small number of wires are needed in dot printing in order to type numerals and characters. Because of this simplicity, dot printing has been widely used in recent years. A variety of printers have been proposed.

According to a typical type of printer, seven wires which are closely arranged in a row in one direction are continuously moved across a very short distance 5 times in a direction perpendicular to the row, and only the required wires corresponding to a character to be typed are struck in each of the five row positions thereby to form dots in the pattern of that character, one desired character is typed by a selected combination of these dots. Similarly, other characters are typed in turn. Ordinarily, in printing a particular character, the order of the wire to be struck in a certain row position is memorized in another apparatus so that the wire strikes dots one after another in a very short time in response to a command from the apparatus. Accordingly, it is possible to type at a high speed of 100 to 200 characters per second.

In order to form a dot, the wire should be fine. In general, the wire has a diameter of about 0.25 to 0.5 mm and a length of about 10 cm. The wire is struck at high speeds and pressures and is used in a bent state in some positions. As a consequence, the wire has been disadvantageous in that it breaks during use in a relatively short time or the working tip or point of the wire, i.e., the contact point with which a copying material or recording paper is contacted, becomes rapidly worn. A variety of proposals have been made to overcome these disadvantages. However, none have been entirely satisfactory.

For example, the material for the wire has heretofore been selected from steel, tungsten, titanium, tantalum, rhenium and tungsten-rhenium alloys. As stated above, these materials have various defects. In order to overcome the above described difficulties, tungsten carbide-cobalt type super hard materials have been proposed. Alternatively, attempts have been made to form a hard coating using such materials as carbides, e.g., tungsten carbide, and nitrides, e.g., titanium nitride, on the point portion of a wire body made of a conventional material.

However, the super hard alloys are somewhat inferior with respect to ductility and tend to break easily. Further, they are difficult to process and work. The coating method is accompanied by the problems of poor adherence of the coating and difficulty in working the coated portion. While these problems have not been solved to a satisfactory extent, a tungsten wire, which is unsatisfactory with respect to wear-resistance, is mainly being used at the present stage of the art.

SUMMARY OF THE INVENTION

It is an object of the present invention to overcome the above described difficulties and to provide a dot printing wire which has excellent wear-resistance, workability, strength and a long service life.

It is another object of the present invention to provide a dot printing wire which greatly reduces the frequency of wire replacement and improves the reliability of the printer in which it is used.

In accordance with the present invention, the above mentioned object can be achieved by providing the point of the wire body with a wear-resistant contact made of an alloy selected from the group consisting of platinum group alloys composed of two or more platinum group metals; alloys of platinum group metals and transition metals; and, alloys of platinum group metals, transition metals and boron.

The nature, utility, and further features of the invention will be more clearly apparent from the following detailed description beginning with a consideration of general aspects of the invention and concluding with specific examples of practice illustrating preferred embodiments of the invention.

DETAILED DESCRIPTION

Figure 1:
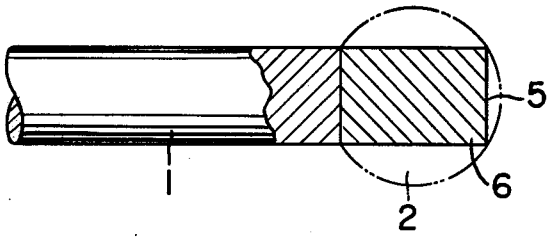
FIGS. 1 and 3 are enlarged side views showing typing ends of dot printing wires according to this invention, at which ends, alloys formed into a spherical shape by melting the constituent metals have been secured to the tips of the respective wire bodies without and with a brazing material, respectively.
Figure 2:
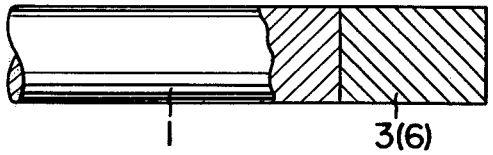
FIGS. 2 and 4 are enlarged side views similarly showing typing ends of dot printing wires according to the invention, at which ends, alloys formed into a cylindrical shape by sintering the constituent metals have been secured to the tips of the respective wire bodies without and with a brazing material, respectively.
Figure 3:
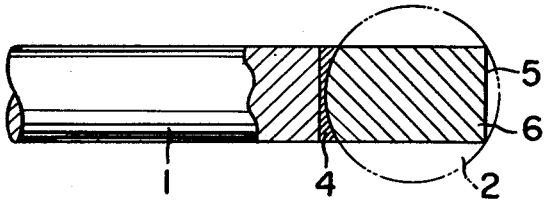
Figure 4:
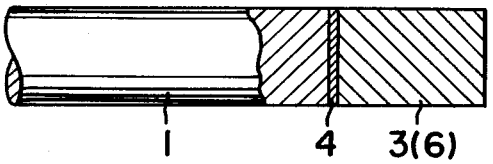

The term "platinum group metal" as used herein refers to a generic name of six elements of ruthenium (Ru), rhodium (Rh), palladium (Pd), osmium (Os), iridium (Ir) and platinum (Pt). In accordance with the present invention, the platinum group metal is used as an alloy of two or more of these metals. We have found that when these metals are respectively used as a single metal, a dot printing wire coated with the metal does not have sufficient wear-resistance and tends to break at a portion between the wire body and the welded metal.

We have found also that among the platinum group alloys of the present invention, an alloy containing osmium is especially preferable. In particular, a binary alloy comprising osmium and a remainder of iridium or platinum is preferable. If a part of the binary alloy is replaced by one or more of the other platinum group metals such as ruthenium, an alloy having almost the same properties can be obtained at a relatively low cost.

Although these alloys of the platinum group metals may be effectively used in the present invention, these metals are expensive, needless to say. In the development of the present invention, it was found that a part of the platinum group metal can be replaced by a transition metal without a substantial deterioration of the properties of the binary- or ternary-alloy of the platinum group metals. In this manner, a reduction in cost is possible.

The transition metals which are usable for the present invention are the metals belonging to the vanadium group, chromium group, manganese group and iron group, such as niobium (Nb), tantalum (Ta), chromium (Cr), tungsten (W), rhenium (Re), iron (Fe), nickel (Ni), and cobalt (Co). Preferably, the alloys of the platinum group metal and the transition metal comprise 10 to 90% by weight, particularly 20 to 50% by weight, of one or more of the platinum group metals, such as osmium, and the remainder one or more of the transition metals.

We have also found that the platinum group metal-transition metal alloy to which boron is added in a quantity of 0.2 to 2% by weight can similarly provide a wire having good wear-resistance and workability.

Examples of the above mentioned alloys will be described below. Some of these alloys will be illustrated in more detail in the Examples described hereinafter.

I. Alloy of platinum group metal (1) Os - Ir, Os - Pt, Ru - Pt (2) Os - Ir - Ru, Os - Ir - Pt (3) Os - Ir - Ru - Pt II. Alloys of a platinum group metal and a transition metal (1) Os - Re (2) Re - Os - Ta (3) Os - Ta alloys to which one or more metals selected from the group consisting of the platnium group metals other than Os, W, Co, Fe, Ni, Cr and Nb are added, for example:

(1) Os - Ta - W (2) Os - Pt - Ta - Ni - W (3) Os - Pt - Ta - Nb - Ni - W (4) Os - Ir - Ru alloys to which one or more metals selected from the group consisting of Pt, Pd, Rh, Fe, Co, Ni and Re are added, for example:

Os - Ir - Ru - Pt - Rh - Re - Co (5) Ir - Ru - Re alloys to which one or more metals selected from the group consisting of Os, Pt, Pd, Rh, Fe, Co and Ni are added, for example:

Ir - Ru - Pt - Rh - Co - Re (6) Re - Ru - W (7) Re - Ru - W alloys to which one or more metals selected from the group consisting of Pt, Pd, Fe, Co and Ni are added, for example:

Re - Ru - Pt - W (8) Re - Ru - Os - W (9) Re - Ru - Os - W alloys to which one or more metals selected from the group consisting of Pt, Pd, Rh, Fe, Co and Ni are added, for example:

Re - Ru - Os - Co - W

(10) Co - Ru - W

III. Alloys of a platinum group metal, a transition metal and boron (1) Re - Os - Ta - B (2) Re - Ru - Ta - B (3) Re - Ru - W - Ta - B These alloys may be prepared by melting or sintering the respective component metals. In the case of sintering, care should be taken to prevent the occurrence of so-called blow holes.

Referring to drawing, the alloy prepared by melting is formed into a sphere 2 having a diameter slightly greater than the diameter of the cylindrical wire body 1, for example, of 0.5 to 1.5 mm, while the alloy prepared by sintering is formed into a cylindrical shape 3 having a diameter equal to that of said wire body. The spherical or cylindrical alloy thus prepared is joined coaxially to the working tip of the wire body 1. The wire body may be made of any metal of the aforementioned steel, tungsten, titanium, tantalum, rhenium, and tungsten-rhenium alloys. In the welding, methods utilizing electric energy, such as arc welding and resistance welding; radiant heat, such as light beam welding; or, heat of the combustion of gases such as acetylene, propane and city gas may be used.

In the welding or joining of the alloy to the tip of the wire body, a brazing material 4 may be used. As the brazing material, any of the brazing materials which are conventionally used, such as carat gold, eutectic gold solders, and industrial gold, silver, and copper solders may be used.

After the afore-mentioned spherical alloy 2 has been welded, without or with the brazing material 4, to the point of the wire body 1 as described above, the welded spherical alloy is ground and polished so as to match the diameter of the alloy with that of the wire body, and the extreme tip portion 5 of the alloy is levelled in the direction perpendicular to the axis of the wire body. Thus the wear-resistant contact part 6 is obtained. A cylindrical alloy 3 can be easily welded, without or with the brazing material 4, to the point of the wire body 1, in order to make a wear-resistant contact part 6. The balling, welding and levelling processes of the alloys of the present invention can be easily carried out. In contrast, a single platinum group metal cannot be easily subjected to these processes, and the workability of such a single metal is inferior.

The wire thus obtained possesses good wear-resistance and workability and an adequate hardness, and, further, it is not easily fractured or broken. Accordingly, the wire of the present invention is very suitable for use as a dot printing wire.

The advantageous features of the dot printing wire of the present invention may be summarized as follows:

(1) The alloy of the wear-resistant contact point has a uniform structure and an ample hardness. (In the case of a super hard metal, a non-uniform mixed structure comprising a hard portion of a carbide or nitride and a relatively soft portion of a joining material such as Co is formed.)

(2) The above named alloy has a Vickers hardness of about 600 to 1,000 and can be easily ground and polished. (In the case of the super hard metal, the Vickers hardness thereof is over 1,500.)

(3) The wire does not break, unlike a super hard metal, and the ductility of the alloy is more controllable than that of a single metal such as Pt or Ru.

(4) The wire has excellent corrosion resistance.

(5) The wire has higher wear-resistance than conventional dot printing wires.

In order to indicate more fully the nature and utility of this invention, the following specific examples of practice are set forth, it being understood that these examples are illustrative only and are not intended to limit the scope of the invention.

EXAMPLE 1

An Ir - Os alloy (weight ratio of 50:50) powder was formed into a spherical body having a diameter of about 0.5 mm by an arc melting method. The sphere was welded to the end of a wire body made of tungsten and having an outer diameter of 0.35 mm by using K18 carat gold as a brazing material by light beam welding.

The welded alloy sphere was ground with green silicon carbide (GC) grind stone so as to match the diameter of the sphere with that of the wire body, and the extreme end portion of the sphere was levelled in the direction perpendicular to the axis of the wire body to make a contact portion. In this example, the weight ratio of Ir to Os in the Ir - Os alloy may vary within the range of 10:90 to 90:10.

EXAMPLE 2

A dot printing wire was produced according to the procedure described in Example 1 except that a Ru - Pt alloy (weight ratio of 90:10) was used instead of the Ir - Os alloy. In this example, the weight ratio of Ru to Pt in the Ru - Pt alloy may vary within the range of 60:40 to 95:5.

EXAMPLE 3

A dot printing wire was produced according to the procedure described in Example 1 except that an Os - Ir - Ru - Pt alloy (weight ratio of 45:35:15:5) was used instead of the Ir - Os alloy. In this example, the weight ratio of Os to the remainder in the Os - Ir - Ru - Pt alloy may vary within the range of 10:90 to 90:10.

EXAMPLE 4

A dot printing wire was produced according to the procedure described in Example 1 except that an Os - Re alloy (weight ratio of 30:70) was used instead of the Ir - Os alloy.

In this example, the weight ratio of Os to Re in the Os - Re alloy may vary within the range of 10:90 to 40:60.

EXAMPLE 5

A dot printing wire was produced according to the procedure described in Example 1 except that a Re - Os - Ta alloy (weight ratio of 40:40:20) was used instead of the Ir - Os alloy. In this example, the weight ratio of Re:Os:Ta in the Re - Os - Ta may vary within the range of 40 to 75:20 to 40:5 to 20.

EXAMPLE 6

A dot printing wire was fabricated according to the procedure described in Example 1 except that a Co - Ru - W alloy (weight ratio of 20:45:35) was used instead of the Ir - Os alloy. In this example, the weight ratio of Co:Ru:W in the Co - Ru - W alloy may vary within the range of 5 to 25:45 to 90: not greater than 50.

EXAMPLE 7

A dot printing wire was fabricated according to the procedure described in Example 1 except that a Re - Os - Ta - B alloy (weight ratio of 60:30:9.5:0.5) was used instead of the Zr - Os alloy. In this example, the weight ratio of Re:Os:Ta:B in the Re - Os - Ta - B alloy may vary within the range of 40 to 70:20 to 40:5 to 20:0.2 to 2.

EXAMPLE 8

A Re - Ru - Ta - B alloy (weight ratio of 80:14:5:1) powder was formed into a spherical body having a diameter of 0.5 mm by an arc melting method. A thin film of an Au - Ge entectic alloy solder was applied onto the surface of the sphere. The sphere thus treated was then welded to the end of a wire body made of tungsten (the tungsten being the same material as that described in Example 1) and having an outer diameter of 0.35 mm by a resistance welding method.

The welding alloy sphere was ground so as to match the outer diameter of the sphere with that of the wire body, and the extreme end portion of the sphere was levelled in the direction perpendicular to the axis of the wire body to make a contact portion. In this example, the weight ratio of Re:Ru:Ta:B in the Re - Ru - Ta B alloy may vary within the range of 50 to 80:14 to 30:5 to 15:0.2 to 2.

EXAMPLE 9

A dot printing wire was produced according to the procedure described in Example 8 except that a Re - Ru - W - Ta - B alloy (weight ratio of 75:14.3:5:5:0.7) was used instead of the Re - Ru - Ta - B alloy. In this example, the weight ratio of Re:Ru:W:Ta:B in the Be - Ru - W - Ta - B alloy may vary within the range of 50 to 75:14 to 35:5 to 30:5 to 15:0.2 to 2.

EXAMPLE 10

Paraffin was added as a binder to the Ru - Pt alloy powder (200 mesh and finer) of Example 2 and mixed therewith to form a homogeneous mixture, which was extruded under a total force of 15 metric tons through a die into a filament. After drying, this filament was cut into pieces of 1-mm. length, which were sintered for approximately three hours in a vacuum sintering furnace under a vacuum of $2\times10^{-4}$ mm. Hg. thereby to fabricate cylindrical structures of 0.35-mm. diameter. These cylindrical structures were secured with an industrial brazing material by using a light beam to the ends of wire bodies made of a tungsten wire material having a 0.35-mm. diameter.

EXAMPLE 11

The procedure of Example 10 was carried out with the exception that the Co - Ru - W alloy of Example 6 in powder form (200 mesh and finer) was used instead of the Ru - Pt alloy.

EXAMPLE 12

The procedure of Example 10 was carried out except for the use of the Re - Os - Ta - B alloy (200 mesh and finer) of Example 7 instead of the Ru - Pt alloy.

COMPARATIVE EXAMPLE 1

A dot printing wire was produced using a tungsten wire having an outer diameter of 0.35 mm and the same properties as those of the tungsten wire of Example 1 without welding of the afore-mentioned alloys.

COMPARATIVE EXAMPLE 2

A dot printing wire was produced according to the procedure described in Example 1 except that a WC-Co sintered alloy (weight ratio of W:C:Co of 88:7:5) was used instead of the Ir - Os alloy.

Each of the dot printing wires of Examples 1 through 9 and Comparative Examples 1 and 2 was pressed down 30 million times on a nylon cloth having a thickness of 120μ and supplied on a metal plate at a rate of 1,400 times per minute by applying a 1 kg load on the point of the wires. After the pressing operation, the wires were examined for cracks and breakage the results are shown in column I in Table 1 below.

Each of the dot printing wires of Examples 1 through 9 and Comparative Examples 1 and 2 were used as a dot printing wire in a dot printer M 101 (using an ink ribbon 21 inches wide for a high speed printer and 55 kg stock homes continuous type paper P1, typing speed 180 characters per second, manufactured by Brother Industry K.K., Nagoya, Japan) and 30 million characters were typed. After typing, the degrees of abrasion wear of the wires were determined. The results are shown in column II in Table 1.

Table 1

| | I | | II |
|---|---|---|---|
| | Abrasion (mm) | Cracking or Breakage | Abrasion wear (mm) |
| Example 1 | less than 0.01 | none | less than 0.01 |
| 2 | 0.02 | " | 0.03 |
| 3 | less than 0.01 | " | less than 0.01 |
| 4 | 0.01 | " | 0.01 |
| 5 | 0.01 | " | 0.01 |
| 6 | 0.03 | " | 0.02 |
| 7 | 0.01 | " | less than 0.01 |
| 8 | less than 0.01 | " | less than 0.01 |
| 9 | less than 0.01 | " | less than 0.01 |
| 10 | 0.03 | " | 0.03 |
| 11 | 0.03 | " | 0.03 |
| 12 | 0.03 | " | 0.03 |
| Comparative Example 1 | 0.15 | " | 0.13 |
| 2 | less than 0.01 | occurred | less than 0.01 |

It is apparent from Table 1 that the dot printing wire of the present invention has a wear-resistance which is more than 5 times that of the conventional dot printing wire.

We claim:

1. A dot printing wire whose printing point is provided with a wear-resistant contact made of an alloy consisting of platinum group metals and transition group metals, said platinum group metals being selected from the group consisting of the combination of osmium and iridium; the combination of osmium, iridium and ruthenium; the combination of osmium, iridium, and platinum, or the combination of osmium, iridium, ruthenium and platinum, wherein the osmium is present in each of said platinum group combinations in an amount of 10–90% by weight based on the total weight of the platinum metals; said alloy also containing a transition metal selected from the group consisting of niobium, tantalum, chromium, tungsten, rhenium, iron, nickel and cobalt, and wherein the platinum group metals are present in an amount of 20–50%, based on the total weight of the transition group metals and platinum group metal combinations in the alloy.

2. A dot printing wire according to claim 1, in which the platinum metal group combination is osmium and iridium.

3. A dot printing wire according to claim 1, in which the platinum metal group combination is osmium, iridium and ruthenium.

4. A dot printing wire according to claim 1, in which the platinum metal group combination is osmium, iridium and platinum.

5. A dot printing wire according to claim 1, in which the platinum metal group combination is osmium, iridium, ruthenium and platinum.

6. A dot printing wire whose printing point is provided with a wear-resistant contact made of an alloy consisting of platinum group metals, transition group metals and boron, said boron being present in an amount of 0.2 to 2.0% by weight, based on the total weight of the alloy, said platinum group metals being selected from the group consisting of the combination of osmium and iridium; the combination of osmium, iridium and ruthenium; the combination of osmium, iridium and platinum or the combination of osmium, iridium ruthenium and platinum, wherein the osmium is present in each of said platinum group combinations in an amount of 10–90% by weight based on the total weight of the platinum metals; said alloy also containing a transition metal selected from the group consisting of niobium, tantalum, chromium, tungsten, rhenium, iron, nickel and cobalt, and wherein the platinum group metals are present in an amount of 20–50% by weight based on the total weight of the alloy.

7. A dot printing wire according to claim 6, in which the platinum group metals are a combination of osmium, iridium, ruthenium and platinum.

* * * * *